United States Patent [19]

Martin et al.

[11] Patent Number: 4,859,270

[45] Date of Patent: Aug. 22, 1989

[54] IN-REGISTER WEB SPLICER

[75] Inventors: John R. Martin, Rockford; Donald E. Carlson, Cherry Valley, both of Ill.

[73] Assignee: Martin Automatic, Inc., Rockford, Ill.

[21] Appl. No.: 95,554

[22] Filed: Sep. 11, 1987

[51] Int. Cl.[4] ..... B65H 19/18

[52] U.S. Cl. ..... 156/361; 156/504; 242/58.1; 242/58.5

[58] Field of Search ..... 156/504, 361, 353; 242/58.1, 58.5

[56] References Cited

U.S. PATENT DOCUMENTS

| | | | |
|---|---|---|---|
| 4,067,760 | 1/1976 | Nelson | 156/504 X |
| 4,262,855 | 4/1981 | Hoag | 156/504 X |
| 4,315,794 | 2/1982 | Palmieri | 242/58.1 X |
| 4,390,388 | 6/1985 | Nagata et al. | 156/504 X |
| 4,432,481 | 2/1984 | Miller | 226/28 X |
| 4,519,858 | 5/1985 | Martin | 156/361 X |
| 4,645,558 | 2/1987 | Sato | 242/58.5 X |

*Primary Examiner*—David Simmons

*Attorney, Agent, or Firm*—McAndrews, Held & Malloy, Ltd.

[57] ABSTRACT

The disclosed web splicing apparatus and method provide for the in-registry lap splicing of a new web, that has a spaced, regularly repeating pattern thereon to an expiring web that has an identical, spaced, regularly repeating pattern thereon and that is moving under tension and at a relatively high speed along a predetermined path of travel. The leading end of the new web is prepared for a splice so that a pattern thereon is aligned with a first pre-selected point. During a splice, a portion of the expiring web is substantially stopped and then moved at a relatively slow speed past a sensor that is positioned at a second pre-selected point downstream from the first pre-selected point and that senses the passage of the next pattern on the slowly moving expiring web. Upon the sensing of the passage of the next pattern, the leading end of the new web is secured to a part of the portion of the expiring web upstream from the second pre-selected point, and the portion of the expiring web is cut upstream from the secured part of the expiring web. Thereafter the joined webs are permitted to run along the path of travel at the relatively high speed.

9 Claims, 5 Drawing Sheets

IN-REGISTER WEB SPLICER

BACKGROUND OF THE INVENTION

The present invention relates to methods and apparatus usable to splice together the leading end of a web from a new roll and the trailing end of a web from an expiring roll running under tension and at a relatively high speed along a predetermined path of travel that includes a running web storage means, such as, for example, a festoon, and a web utilization apparatus, such as, for example, a package forming and filling machine. More particularly, the present invention relates to methods and apparatus adapted to form a lap splice of the type described where the new and expiring webs each have identical, spaced, regularly repeating patterns thereon and where it is important that the patterns on the joined new and expiring webs be in-register.

Apparatus and methods for forming lap splices to join together new and expiring webs have previously been known and used. Examples of such prior apparatus and methods are disclosed in U.S. Pat. No. 4,519,858 which issued on May 28, 1985 and which is incorporated herein by reference. The apparatus and methods disclosed in that patent cannot, however, accurately, consistently and quickly splice new and expiring webs having identical, spaced, regularly repeating patterns thereon such that the patterns on the spliced webs will be in-register (that is, the spacing between adjacent patterns across the joined portion of the new and expiring webs are the same as the spacing between adjacent patterns on the new web and on the expiring web).

A web splicer embodying the present invention is intended to replace a manual splicing operation that is being used with a machine that forms the running web into single serve packets, fills the packets with powdered, non-dairy creamer material, and then seals the filled packets. In this manual splicing operation, the new and expiring rolls are mounted on side by side spindles. When it is time for a splice to be made, both the running web and the forming and filling machine have to be stopped. The expiring web is cut, and the cut trailing end of the expiring web is secured to the leading end of the new web by hand. Care has to be taken to be sure that the patterns printed on the new and expiring webs are in-registry. The joined webs are then permitted to run again and the forming and filling machine is restarted.

This manual splicing operation had a number of serious disadvantages. It is quite slow, and thus, constitutes a major interruption to the production of the single serve non-dairy creamer packets. It also involves considerable wastage. Not only is the web remaining on the expiring roll wasted, but additionally, there is significant wastage involved in the stopping and starting the forming and filling machine.

SUMMARY OF THE INVENTION

In principal aspect, the present invention relates to an improved apparatus and method for consistently and accurately forming an in-register splice between the leading end of a new web and the trailing end of an expiring web where each of the webs have identical, spaced, regularly repeating patterns thereon. More particularly, the apparatus and methods of the present invention are an improvement over the apparatus and methods disclosed in U.S. Pat. No. 4,519,858.

As noted, a prototype of a web splicer embodying the present invention has been constructed to splice webs employed with a machine that uses the webs to form and fill single serve non-dairy creamer packets. Tests have demonstrated that this prototype splicer is capable of accurately and consistently forming in-register splices at production line speeds.

Because of its simple construction, a new web splicer embodying the present invention should be relatively inexpensive to manufacture. Additionally, wastage of web and packets is so minimal, relative to the prior manual splicing operation, that it appears that the new splicer will be able to pay for itself in savings in wastage within a short period of time.

Accordingly, it is a primary object of the present invention to provide an improved apparatus and method adapted for forming splices between new and expiring webs of material having identical, spaced, regularly repeating patterns thereon where the patterns on the joined new and expiring webs are accurately and consistently in-registry. A related object of the present invention is to provide an improved splicing apparatus and method as described where the in-registry splicing may be accomplished by use of a relatively inexpensively manufactured splicer and where the wastage occurring as a result of a splice is minimal.

Another object of the present invention is to provide an improved splicing apparatus and method as described where the expiring web is being run along a predetermined path of travel having a first section and then proceeding to a running web storage means and next to a web utilization apparatus; where the pattern on the leading end portion of the new web is held in alignment with a first pre-selected point prior to a splice; where at the initiation of a splice, a portion of the expiring web in the first section of the path of travel is momentarily stopped; where the stopped portion of the expiring web is then moved or advanced relatively slowly moved downstream until the next pattern thereon passes a second pre-selected point downstream from the first pre-selected point; where the leading end of the new web is secured to the adjacent part of the portion of the expiring web; where the expiring web is cut upstream of the secured part; and where the joined new and expiring webs are permitted to again run along the path of travel. A related object of the present invention is to provide an improved splicing apparatus and method as described where the roll of expiring material is mounted upstream from the first section so that the expiring web may be run under tension and at the relatively high speed along the path of travel; and where the roll of ne material is also mounted upstream from the first section of the path of travel so that the new web may be led to and into the first section of the path of travel in preparation for a splice and so that the new web, when joined with the expiring web, may then be run under tension and at the relatively high speed along the path of travel.

Still another object of the present invention is to provide an improved splicing apparatus and method as described where a first idler roll is positioned adjacent to the entrance to the first section of the path of travel and is adapted to have the expiring web pass about its peripheral surface; and where the movement of the expiring web in the first section of the path of travel is momentarily stopped by the cooperation between the first idler roll and a first braking roll that is adapted to be pressed against the first idler roll during a splice so as to clamp the expiring web therebetween. A related object of the present invention is to provide an improved web splicing apparatus and method as described where the side of a bar is pressed against the first braking roll so as to cause the braking roll to, in turn, be pressed against the first idler roll to stop the expiring web during a splice; and where the bar is then slowly moved, in a direction parallel to its central longitudinal axis and while pressed against the first braking roll, to cause the portion of the expiring web to move slowly along the first section of the path of travel.

Yet another object of the present invention is to provide an improved web splicing apparatus and method as described where a second idler roll is also mounted adjacent to the entrance of the first section of the path of travel and is adapted to have the new web passed about its peripheral surface; where a second braking roll is mounted so that it may be selectively pressed against the second idler roll so as to clamp the web passing therebetween as when the new web is to be replaced by another new web; where the bar may be selectively pressed against the second braking roll so as to cause the web passing between that roll and the second idler roll to be clamped therebetween; and where the bar may be moved in a direction parallel to its longitudinal axis so as to cause the web passing between the second idler roll and the second braking roll to be slowly moving into the first section of the path of travel.

These and still other objects, advantages and aspects of the present invention are more fully set forth in the detailed description of the preferred embodiment of the present invention which follows.

DESCRIPTION OF THE DRAWINGS

In the detailed description of the invention which follows, reference will be made to the accompanying drawings comprised of the following Figures.

DETAILED DESCRIPTION OF THE PREFERRED EMBODIMENT

Figure 1:
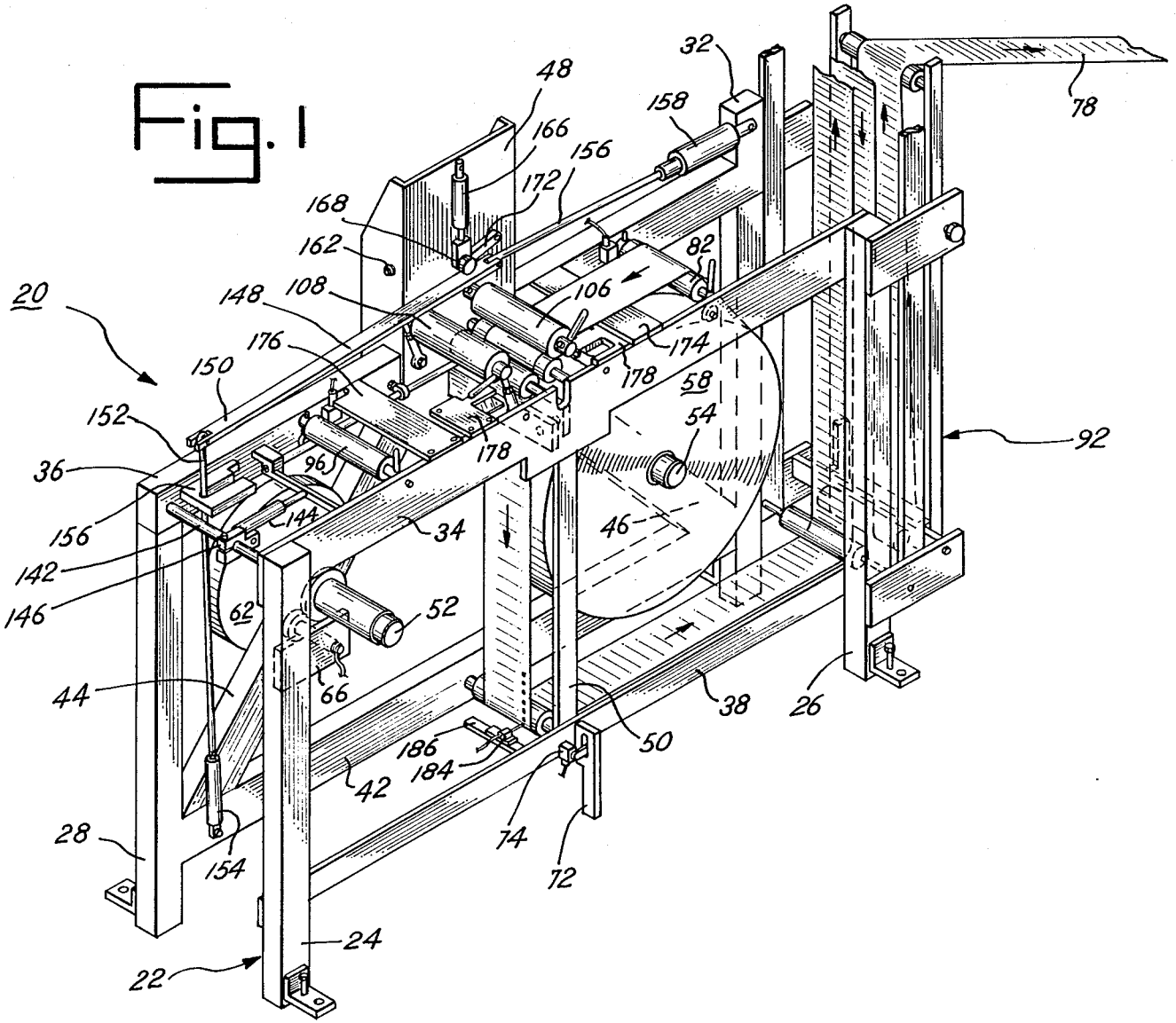
FIG. 1 is a left-side perspective view of a web splicer embodying the present invention.
Figure 2:
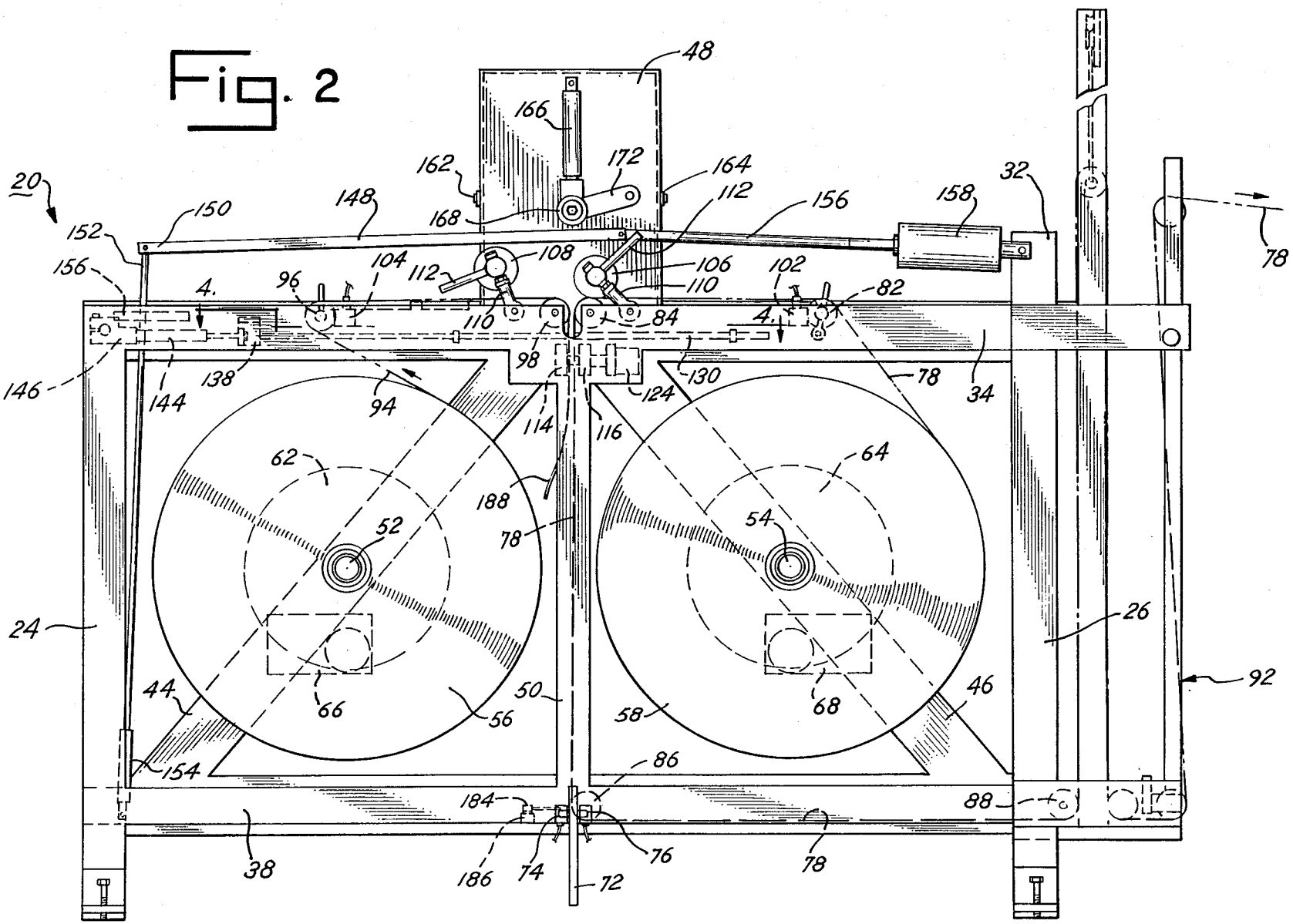
FIG. 2 is an enlarged, side elevational view of the splicer shown in FIG. 1.
Figure 3:
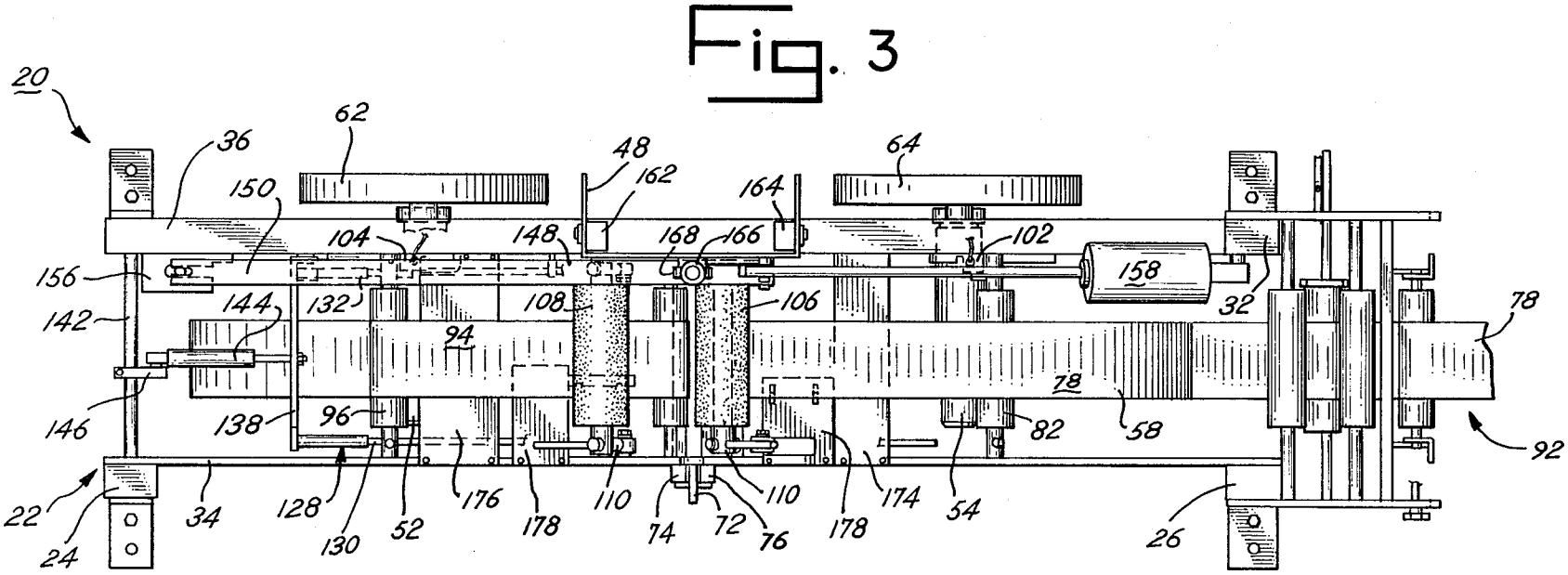
FIG. 3 is a top plan view of the splicer shown in FIG. 2.

Referring first to FIGS. 1–3, a web splicer embodying the present invention is generally shown at 20. The splicer includes a rigid frame 22 comprised of a pair of front corner posts or legs 24 and 26, and a pair of rear corner posts or legs 28 and 32. An upper front transverse member 34 extends between the upper ends of the posts 24 and 26, and an upper rear transverse member 36 extends between the upper ends of the posts 28 and 32. A lower front transverse member 38 extends between the posts 24 and 26 adjacent to their lower ends, and a lower rear transverse member 42 extends between the posts 28 and 32 adjacent to their lower ends. Diagonal support members 44 and 46 extend from adjacent the intersections between the rear transverse member 42 and the rear posts 28 and 32, respectively, and the midpoint of the rear transverse member 36. A splicer head member 48 is mounted on the member 36 adjacent its midpoint and projects upwardly from the member 36. A vertical support member 50 extends between the midpoints of the front transverse members 34 and 38.

Conventional chucks or spindles 52 and 54 are mounted on the diagonal members 44 and 46, respectively, and project forwardly. As best illustrated in FIGS. 2–5, these chucks are adapted to receive web material rolls 56 and 58 so that they may be rotated at relatively high speed on the chucks as hereinafter described. The chucks 52 and 54 are connected with brake discs 62 and 64, respectively, by conventional means.

Conventional brakes 66 and 68 are adapted to cooperate with the chucks so as to brake the rotation of the rolls 56 and 58. Normally the brakes hold the chucks against rotation when web from a roll is not running through the splicer. The operator may temporarily release these brakes 66 and 68 by actuating a foot lever 72 mounted for pivotal movement about its upper end on the member 38 adjacent to the intersection between the members 38 and 50. Movement of the lever 72 to one side or the other actuates the adjacent, conventional switches 74 and 76 which are connected with brakes 66 and 68, respectively, and which when actuated, cause the connected brake to be released so that a roll mounted on the associated chuck 52 or 54 may be rotated.

In FIG. 1, a web 78 is shown running off of the right hand roll 58 mounted on the chuck 54. No roll is shown mounted on the chuck 52. As the web 78, which is the expiring web, leaves the roll 58, it moves along a path of travel under tension and at a relatively high speed, that is, approximately four-hundred feet per minute. More specifically, the web 78 passes about the periphery of a conventional idler roller 82. The web then travels along a first generally horizontal path to a second idler roll 84. After passing about the roll 84, the web 78 travels along a first vertical section of the path of travel to the idler roll 86 whose ends are journaled for rotation between the members 38 and 42. The web 78 then passes along a second generally horizontal path to another idler roll 88 whose ends are also journaled for rotation between the members 38 and 42 and which is located at the entrance of a festoon 92 or running web storage means.

The festoon 92 is of conventional design and construction. It acts as an accumulator for the running web 78 such that the web utilization apparatus (not shown) does not have to be stopped when a portion of the web 78 in the splicer 20 is stopped during a splicing operation. The festoon 92 may be mounted, in part, on the posts 26 and 32 as shown in FIGS. 1–3.

After passing through the festoon 92, the web 78 continues to a web utilization apparatus. This apparatus may, for example, be a machine used to form single serve non-dairy creamer packets having a length of approximately two inches. When the web 78 is used to form such packets, the web 78 will have a spaced, regularly repeating pattern of printing on one of its sides. Each of the patterns of printing will be identical and may comprise the trademark identification for the non-dairy creamer material, that will appear on the front face of each packet, and a listing of the ingredients and the distributor's name and address, that will appear on the rear face of each packet. Each pattern will also include a register or timing mark.

As best shown in FIGS. 2 and 3, the new roll 56 of material is mounted for rotation on the chuck 52. The leading end portion of the web 94 from the roll 56 is adapted to be led around a first idler roller 96 and then along a generally horizontal path to and about a second idler roll 98 in preparation for a splicing operation. One side of the web 94 will have spaced, regularly repeating patterns of printing that are identical, in spacing and content, to the patterns on web 78. It is obviously critical that when the webs 78 and 94 are spliced together, the spacing between adjacent patterns on the joined webs be the same as the spacing between the patterns on the web 78 and on the web 94. Otherwise the printing on the packets will be offset and the packets will not be saleable. Additionally, since the patterns of printing must obviously be on the outside of the packets, the webs 79 and 94 must always pass into the forming and filling machine with their printed sides facing in the same direction. To accomplish this, the rolls 56 and 58 must both be unwound in a counter-clockwise direction, as viewed in FIGS. 1 and 2, so that the printed side of the webs will always face left as it passes along the first vertical section of the path of travel.

The idler rolls 82 and 96 ar identical in structure and function. Each is mounted for rotation between the members 34 and 36 but each may be pivoted from their first positions, shown in FIG. 2, clockwise in the case of roll 82 and counterclockwise in the case of roll 96, to second positions. The idler rolls 82 and 96 are held in their first positions by the tension of the webs 78 and 94. Conventional sensors 102 and 104 are associated with the idler rolls 82 and 86, respectively. When one of the idler rolls 82 or 96 moves to its second position, this movement is sensed by its associated sensor. Tension in a web may be lost by the tail end of the web running off of its respective roll.

The idler rolls 84 and 98 are likewise identical in structure and function. Both are mounted for rotation between the members 34 and 36. They are positioned adjacent to the entrance of the first vertical section of the path of travel of the webs and are on opposite sides of the vertical plane defined by this vertical section.

A pair of structurally and functionally identical braking rolls 106 and 108 are mounted between the transverse members 34 and 36. They are adapted to associate and cooperate with the idler rolls 84 and 98, respectively, as hereinafter described. More specifically, both are mounted for rotation on crank arm assemblies 110 so that their central longitudinal axes are parallel to the central longitudinal axes of their associated idler rolls. The assemblies 110 are, in turn, connected, for limited pivotal movement, with the transverse members 34 and 36, just upstream from their associated idler rolls 84 and 98. Both may be moved between a first position, assumed by roll 106 in FIGS. 1 and 2, and a second position, assumed by roll 108 in FIGS. 1 and 2. Handles 112 may be used to move the rolls 106 and 108 between their two positions. When the rolls 106 and 108 are in their first positions, surface to surface contact would exist between the peripheral surfaces of these rolls and their associated idler rolls 84 and 98 without a web being disposed therebetween. When the rolls 106 and 108 are in their second positions, these rolls are spaced from their associated idler rolls.

Figure 4:
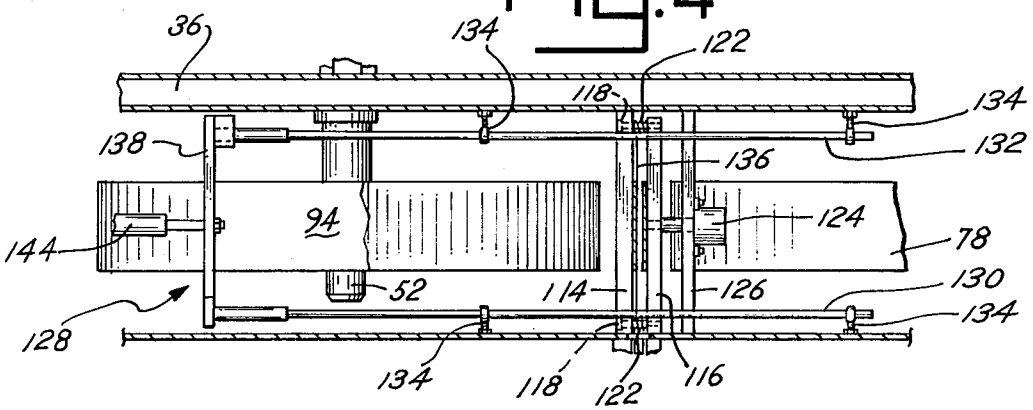
FIG. 4 is a partial cross-sectional view taken along a line 4—4 in FIG. 2.

A conventional anvil 114 is mounted downstream from the idler rolls 84 and 98 and adjacent to one side of the first vertical section of the path of travel of the webs. A conventional hammer 116 is supported for reciprocal movement on the other side of the vertical section of the path of travel from the anvil 114. As best illustrated in FIG. 4, the movement of the hammer is guided by pins 118 secured to the side edges of the anvil 114. Coil compression springs 122 are carried by the guide pins 118 and bias the hammer away from the anvil.

A conventional pneumatic cylinder 124 is mounted midway between the members 34 and 36 on a cross piece 126. The cylinder 124 is connected with the hammer 116. Normally the hammer is spaced from the anvil so that the webs 78 and 94 may freely move therebetween. When actuated, the cylinder 124 will slam the hammer sharply against the anvil 114. The springs 122 will thereafter immediately cause the hammer 116 to return to its normal position where as noted, it is spaced from the anvil a sufficient distance to allow the webs to pass freely between them.

A web cutting assembly 128 is mounted in a generally horizontal plane between the idler rolls 84 and 98 and the anvil and hammer 114 and 116. This assembly 128 includes a pair of parallel rods 130 and 132 that are mounted adjacent to the inside, facing surfaces of the members 34 and 36, respectively, by a plurality of holders 134. These rods are mounted in the holders 134 so that they may be reciprocally moved in directions parallel to their central longitudinal axes. A wire 136 is tightly stretched between opposed points on the rods 130 and 132. The point of connection between the wire 136 and the rods is selected s that the wire is disposed adjacent to the vertical section of the path of travel of the webs.

A yoke 138 connects the left hand ends of the rods 130 and 132, as viewed in FIGS. 3 and 4. This yoke 138 is positioned between the first vertical section of the path of travel and the posts 24 and 28.

A rod 142 extends between the transverse members 34 and 36 adjacent to the upper ends of the posts 24 and 28. A conventional double acting pneumatic cylinder 144 has its rod end connected with the yoke 138 and its cylinder end pivotally connected with and mounted on the rod 142 by block and linkage 144. Actuation of the cylinder 144 causes the yoke, the rods 130 and 132, and thus the wire 136 to be moved rapidly, through a small stroke length, to the right or left. Such movement of the wire 136 against a web under tension will sever the web.

As noted above, the portion of the running web passing through the vertical section of the path of travel is substantially stopped during a splice. Thereafter, the stopped portion of the web is slowly moved in the first vertical section. The stopping of the running web is caused by the surface to surface pressure exerted by a braking roll 106 or 108 and its associated idler roll 84 or 98 on the web. To effect a stoppage of the running web, a bar 148 is forced against a portion of the upper peripheral surface of the active braking roll as hereinafter described. The bar is longer than one-half of the length of the splicer (that is, longer than one-half the distance between the posts 24 and 28 and the posts 26 and 32). It is supported above the braking rolls 106 and 108 as hereinafter described.

More specifically, one end 150 (the left end in FIG. 2) of the bar 148 extends near to the vertical plane defined by the posts 24 and 28 and is pivotally connected with the extended rod end 152 of a conventional double acting pneumatic cylinder 154. The other, cylinder end of the cylinder 154 is connected, for limited pivotal movement, with the inside facing surface of the transverse member 42 adjacent to the post 28. The portion of the rod end 152 extends through an elongated slot formed in a member 156 that may include sensors, not shown, for sensing the position of the rod end 152. The member 156 is secured to the inside facing surface of the member 36 adjacent to the upper end of the post 28. The longitudinal axis of the slot in the member 15 is generally parallel with the longitudinal axis of the transverse member 36.

The other end (the right hand end in FIG. 2) of the bar 148 extends beyond the braking roll 106 and is pivotally connected with the rod end of a conventional double acting cylinder 158. The other, cylinder end of the cylinder 158 is connected, for limited pivotal movement, with the upper end of the post 32. The cylinder 158 is adapted to reciprocally move the bar 148 at a relatively slow rate to the left or right (as viewed in FIG. 2) in a direction generally parallel with the longitudinal central axis of the bar.

The bar 148 has generally flat upper and lower surfaces. When the brake rolls 106 and 108 are in their first position (that is, in the position where the are in surface to surface contact with their associated idler rolls 84 and 98, respectively) the lower surface of the bar 148 may be brought into surface to surface contact with the peripheral surface of one or the other of the rolls 106 or 108. When the left end 150 of the bar is moved to an upper position, by the actuation of the cylinder 154, the lower surface of the bar 148 is adapted to contact the braking roll 106. Conversely, when the left end 150 of the bar 148 is moved to its lower position, again by actuation of the cylinder 154, the lower surface of the bar 158 is adapted to contact the surface of the braking roll 108.

Actuation of the cylinder 154, and thus the position of the left hand end 150 of the bar 148, is controlled by the operator by means of a pair of switches 162 and 164 mounted on opposite sides of the splicer head member 48. Depressing the switch 164 will cause the cylinder 154 to move the left end 150 of the bar 148 to its lower position so that the bar will engage the braking roller 108. Depressing the switch 162 will cause the cylinder 154 to raise the left hand 150 of the bar 148 to its upper position whereby the bar 148 will engage the braking roll 106.

A conventional single acting, spring return, pneumatic cylinder 166 is mounted on the splicer head member 48. (When its extended position, the cylinder 166 is adapted to force the lower surface of the bar 148 against the peripheral surfaces of either the braking roll 106 or 108, again, depending on the vertical position of the left end 150 of the bar 148. More specifically, the cylinder end of the cylinder 166 is connected, for limited pivotal movement, with the upper end of the member 48. The rod end of the cylinder 166 is connected with a wheel or roller 168. This wheel is adapted to engage the upper surface of the bar 148 when the cylinder 166 is in its extended position. A link 172 is pivotally connected, at one end with the rod end of the cylinder 166 and the wheel 168 and at its other end with the member 48. The link serves to limit the lateral movement of the wheel 168. A hook, not shown, depends from the rod end of the cylinder 166 below the lower surface of the bar 148. It serves to support the bar 148 below the wheel 166 but above the braking rolls 106 and 108 when the cylinder 166 is in its retracted position.

Actuation of the cylinder 16 from its retracted position to its extended position causes the wheel 168 to press against the upper surface of the bar 148. This pressure causes the lower surface of the bar 148 to press tightly against the underlying braking roll. Such pressure on the braking roll, in turn, causes the web traveling between that braking roll and its associated idler roll to be clamped therebetween. This causes the web to substantially stop running.

Figure 12:
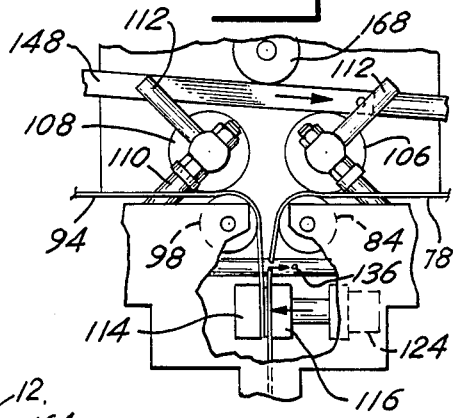
FIG. 12 is a enlarged partial side elevational view taken along the line 12 in FIG. 11.
Figure 11:
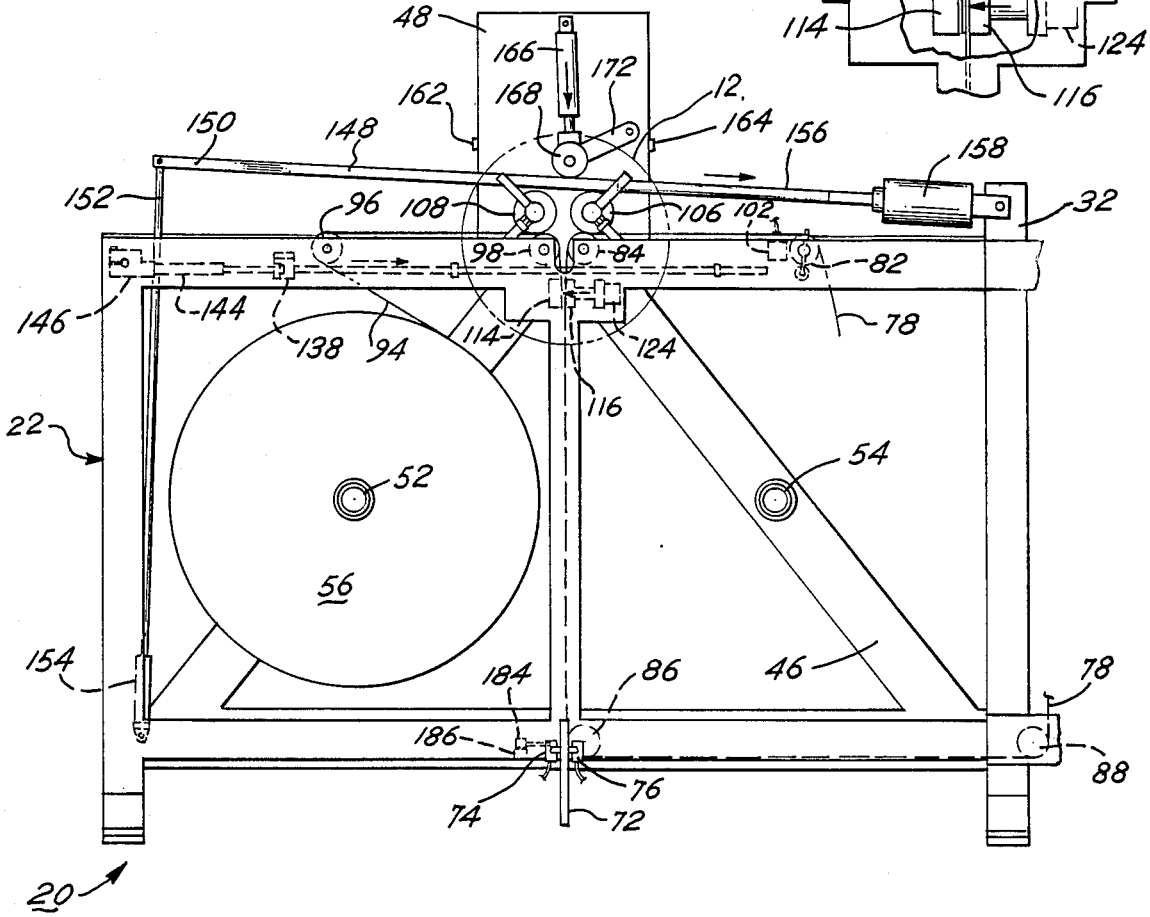
FIG. 11 is still another side elevational view of the splicer shown in FIG. 2 where the bar is shown being pressed against the web braking roll used in connection with the expiring web.

After the moving web has been clamped by the above described action of the cylinder 166, the wheel 168, bar 148 and braking roll, actuation of the cylinder 158 causes the bar 148 to move slowly in a direction substantially parallel to its central longitudinal axis. Such longitudinal movement of the bar 148, when pressed against a braking roll, causes the braking roll to rotate relatively slowly. More particularly and as best seen in FIGS. 11 and 12, the cylinder 156 moves the bar from left to right. The roll 106 is thus forced to rotate clockwise. This rotation of the braking roll 106 causes the web 78, clamped between the roll 106 and its associated idler roller 84, to move at a relatively slow rat of speed, for example, approximately forty feet per minute, in the first vertical section.

To enable the splicer 20 to splice the new and old webs 78 and 94 so that their patterns are in registry, the leading end portion of a new web must be properly prepared. To assist in doing this, platforms 174 and 176 are mounted between the upper transverse members 34 and 36. The platform 174 is mounted between the idler roll 82 and the braking roll 106, and the platform 176 is positioned between the idler roll 96 and the braking roll 108. The upper surfaces of these platforms are flat and are generally parallel to but spaced just below the horizontal path of travel of the webs passing there above. The platforms provide the operator with a work area where he can apply adhesive tape to the leading end of a new web and then trim the leading end so that for example, its leading end bisects a register mark.

Registry tables 178 are similarly mounted between the upper transverse members 34 and 36. These tables 178 are positioned between the platform 174 and the roll 84 and between the platform 176 and the roll 98. Like the platforms, the upper surfaces of these tables 178 are flat and are generally parallel to but spaced just below the horizontal path of travel of the webs passing there above. Each of the tables includes an integral, relatively narrow projection 180 that extends downstream from one of its side edges. Each projection has at least two indicating marks on its upper surface. These indicating marks are spaced apart, in a direction parallel to the path of travel, a distance equal to the distance between adjacent register marks on the webs. The indicating marks are arranged on the projections 180 so that the operator may easily and quickly align them with two of the register marks on the leading end portion of the new web during his pre-splice preparation of the new web.

Figure 8:
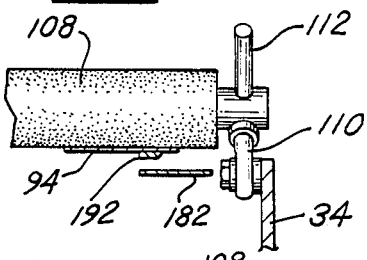
FIG. 8 is a partial cross-sectional view taken along the line 8—8 in FIG. 7.
Figure 9:
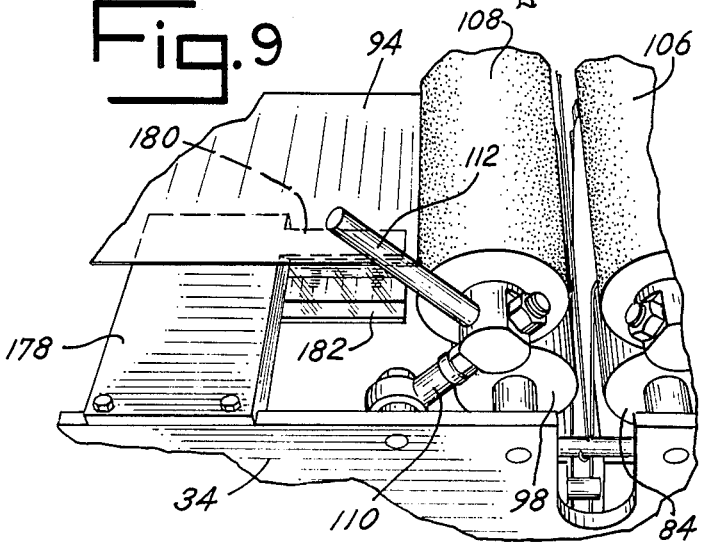
FIG. 9 is a partial left-side perspective view showing the means for aligning the leading end portion of a new web.

Referring to FIGS. 8 and 9, conventional mirror systems 182 are carried by the tables 178 below their upper surfaces and adjacent to their projections 180. These systems facilitate the operator's alignment of the indicating marks with the web's register marks (an exaggerated one such mark being indicated at 192 in FIG. 8) when the patterns on the new web are face down (that is, facing the upper surfaces of the associated platform and table).

A conventional register mark reader or sensor 184 is mounted on a piece 186 between the members 38 and 42. The reading head of the sensor 184 is positioned adjacent to the first vertical section of the path of travel of the webs. It is aligned with the register marks on the web 78 as these marks move past the head. A sensor which may be used is Model FEB7-FRDA6-M made by Micro-Switch of Freeport Illinois. The reading head of the sensor 184 is positioned so that the distance, along the path of travel, between it and the indicating marks on the projections 180 of the tables 178 is a multiple of the distance or spacing between adjacent register marks on the webs 78 and 94.

Figure 5:
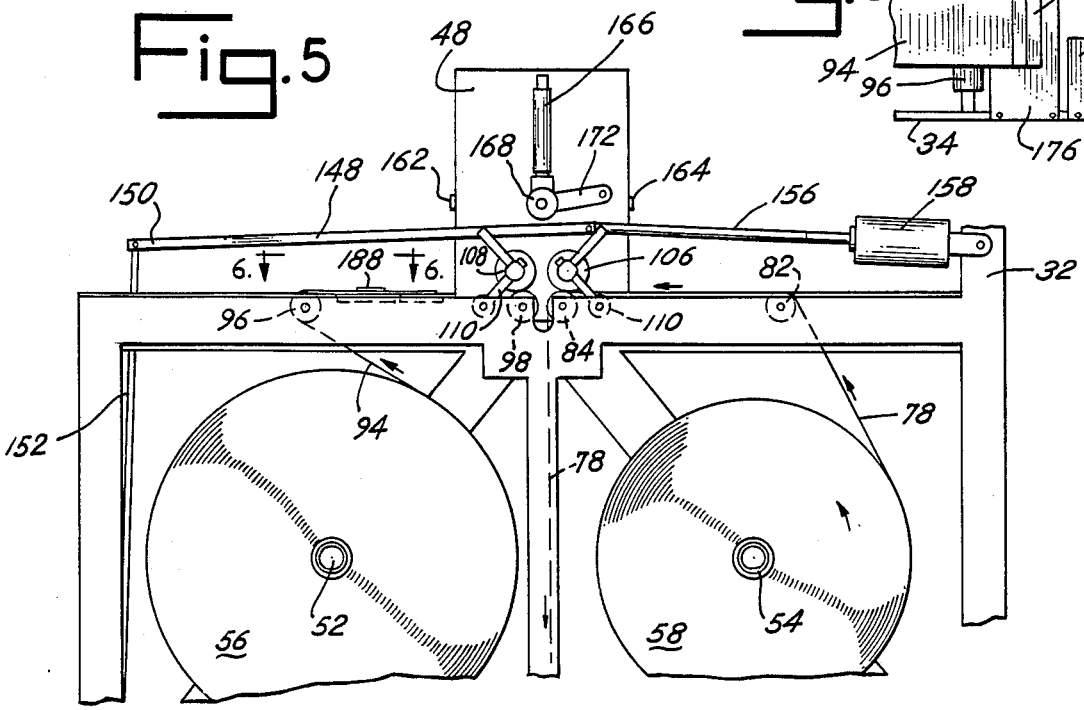
FIG. 5 is a partial, side elevational view of the splicer shown in FIG. 2 where the leading end of the new web is shown being prepared for a splice.
Figure 6:
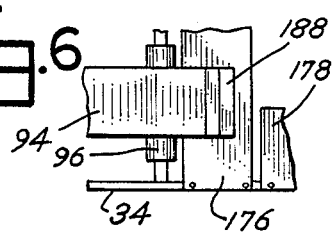
FIG. 6 is a partial cross-section view taken along the lines 6—6 in FIG. 5.
Figure 7:
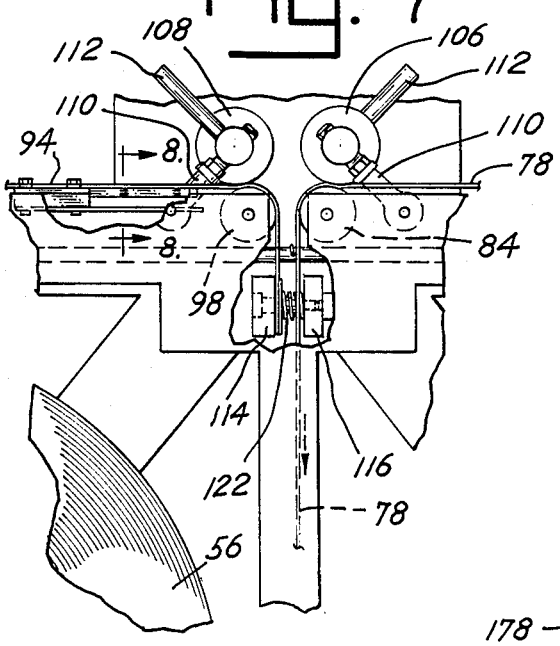
FIG. 7 is an enlarged, partial side elevation view showing the leading end of the new web in position for a splice.

Preparation for the next splice may commence after a splice has been completed. The operator first removes the expired roll from the chuck, for example, the chuck 52 as illustrated in FIG. 1. He next puts the new roll 56 on the chuck 52 as illustrated in FIGS. 2–5. The leading end portion of the web 94 is then led around the idler roller 96 and to the platform 176. With reference to FIGS. 5 and 6, the operator then applies one side of a strip of double faced adhesive tape 188 to the upwardly facing side of the end of the web 94. He leaves the removable covering sheet on the other face of the tape. It is not necessary for him to carefully align the strip of tape with the leading end of the web 94 so long as a substantial portion of the tape overlies the leading end. He next cuts off the overhanging parts of the tape using the platform 176 as a cutting surface. He must be sure, however, when cutting the tape off of the leading edge of the web, that the cut line substantially bisects a register mark on the web. In other words, the trimmed leading edge of the new web 94 will have one-half of a registry mark.

The operator next moves the braking roll 108 to its second position, as shown in FIG. 2, by grasping the handle 112. He then leads the trimmed leading end of the web 94 beneath the roll 108 and around the roll 98. As noted above, the running web 78 is still running at a relatively high rate of speed about the idler rolls 82, 84, 86, 88 and thus into and through the festoon 92. There is, however, sufficient space between the peripheries of the rolls 84 and 98 so that the operator can safely lead the leading end of the web 94 between these rolls.

The operator then carefully feeds the leading end of the web 94 down past the wire 136 which as noted above is part of the web cutting assembly 128. Before doing this, he must manually move the wire 136, by grasping the yoke 138, so that the wire 136 is closely adjacent to the running web 78 and so that the wire will be between the webs 78 and 94 after the leading end of the web 94 has been fed past the wire 136.

The operator next feeds the leading end of the web past the anvil 114 as shown in FIG. 2. At this time and while the web 178 is running, the hammer 116 is positioned to the right of the vertical section of the path of travel of the web 78 as again shown in FIG. 2. The operator feeds the leading end of the web 94 sufficiently past the anvil 114 so that he can easily remove the covering sheet from the other face of the tape 188.

The operator next trips the lever 72 with his foot so that the brake 66 is released. While this brake is released, he slowly, manually moves the roll 56 in a clockwise direction until the trimmed leading edge of the web 94 is adjacent to the lower edge of the anvil 114. He then returns the lever 72 to its vertical position so that the brake 66 is again applied.

Figure 10:
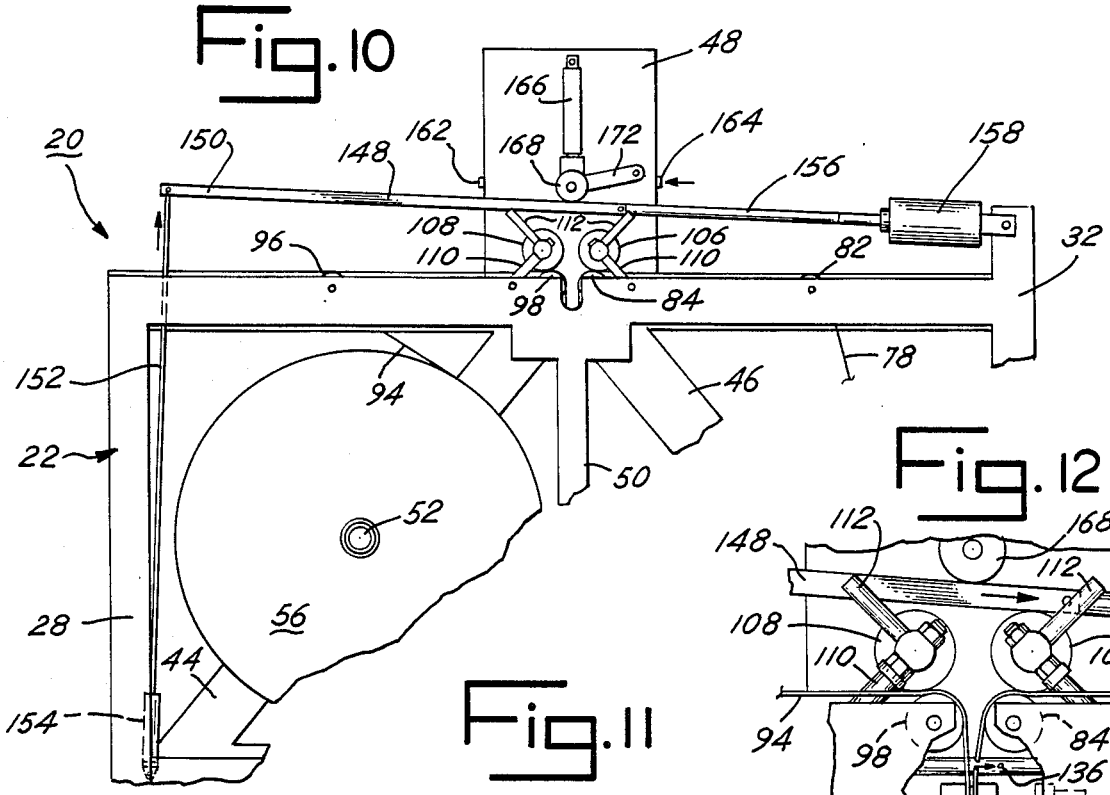
FIG. 10 is another partial, side elevational view of the splicer shown in FIG. 2.

He moves the brake roll 108 to its first position as shown in FIGS. 5, 7, 9, 10 and 12. The preparation for a splice is completed by the operator depressing the switch 162. This causes the cylinder 154 to move the left end 150 of the bar 148 to its upper position as shown in FIG. 10.

The web splicer 20 is now ready to make another splice. A splice may be initiated manually by the operator or automatically as when the tailing end of the web 78 leaves the roll 58. At that time, the tension in the trailing end of the web 78 drops. This causes the idler roll 82 to pivot to its second position. This movement of the idler roll 82 is sensed by the sensor 102. The sensor 102 sends a signal which actuates the cylinder 166.

Actuation of the cylinder 166 drives the wheel 168 rapidly downward against the upper surface of the bar 148. This, in turn, causes the lower surface of the bar 148 to be brought into surface to surface contact with the peripheral surface of the braking roll 106. The roll 106 is then pressed tightly against the web 78 as it passes around the idler roll 84. The pressure between the roll 84 and 106 clamps trailing end of the web 78 tightly and stops the movement of the web 78 along the first vertical section of the webs path of travel. The stoppage of the web in this first section of the path of travel does not, however, stop the running of the web 78 downstream from the festoon 92. In a conventional manner, the festoon 92 continues to feed out web while the splice is being made.

As soon as the web 78 is substantially stopped, the cylinder 158 moves the bar 148 slowly in the direction from left to right as illustrated in FIG. 10. Similarly, the sensor 184 is activated. This longitudinal movement of the bar 148 causes the roller 106 to rotate in a clockwise direction as the bar is still being tightly pressed against the braking roll 106 by the cylinder 166. The movement of the bar 148 and roll 106 causes the web 78 in the first vertical section to be slowly moved.

As a result, a register mark on the web 78 is moved past the sensor 184. In response to the sensor 184 "reading" the passage of that registry mark, cylinders 124 and 144 are actuated. This causes the cylinder 124 to slam the hammer 116 rapidly against the anvil 114 thereby pressing the exposed face of the tape 188 against the adjacent part of the web 78 so as to secure the leading end of the web 94 to the adjacent portion of the web 78. Simultaneously the cylinder 144 causes the yoke 138, the rods 130 and 132 and the wire 136 to move rapidly to the right as shown in FIGS. 2, 4 and 12. This movement of the wire 136 with respect to the web 78 (which as noted above is still under tension) cuts the web 78 at a point upstream from the anvil 114.

Without delay, the springs 122 return the hammer 116 to its right hand position where it is spaced from the first section of the vertical section of the path of travel of the webs. Similarly, the cylinder 166 is returned to its upper or retracted position, shown in FIG. 2, so that the wheel 168 no longer exerts pressure on the bar 148. At that time, the joined webs 78 and 94 are then free to move along the path of travel. As a result of the splice, only a few packets will have to be wasted. This minimal wastage is, of course, due to the fact that the adhesive tape 188 overlays only a few patterns.

The web splicer 20 is now ready to be prepared for another splice. To do this, the preparatory steps noted above need to be repeated with respect to the next new roll that will replace expired roll 58. Moreover, since the next splice will involve the braking roll 108, the end 150 of the bar 148 needs to be moved to its lower position, as generally shown in FIGS. 2 and 5. The end 150 is moved to that position by depressing the switch 164.

We claim:

1. An improved in-register web splicer adapted for forming a splice to join together: (a) a web from an expiring roll of material that has spaced, regularly repeating patterns, including a register mark, thereon and that is being run downstream from the expiring roll along a predetermined path of travel having a first section and then proceeding to a running web storage means and next to a web utilization apparatus; and (b) a web from a new roll of material that has a leading end portion and that has the identical spaced, regularly repeating patterns thereon, whereby the patterns on the joined new and expiring webs will be in-register, the improved web splicer comprising:

(1) means for mounting the expiring roll so that the expiring web may be run under tension and at a relatively high speed along the path of travel, with the expiring web passing about a first idler roll that is disposed adjacent to the path of travel of the expiring web and between the expiring roll and the first section of the path of travel;

(2) means for mounting the new roll so that the new web may be led to and into the first section of the path of travel in preparation for a splice and so that the new web, when joined with the expiring web, may then be run under tension and at the relatively high speed along the remainder of the path of travel, with the new web passing about a second idler roll that is disposed adjacent to the path of travel of the new web and between the new roll and the first section of the path of travel;

(3) means for preparing the leading end of the new web for a splice along the first section of the path of travel including holding a pattern on the leading end portion of the new web adjacent to a first preselected point so that a pattern on the leading end portion of the new web is aligned with the first preselected point;

(4) means for braking the expiring web during a splice so that a portion of the expiring web in the first section of the path of travel momentarily stops running, the braking means including: (a) first and second braking rolls that are disposed adjacent to and associated with the first and second idler rolls, respectively, and that are each selectively movable between a braking position and a non-braking position with respect to their associated idler roll, with each of the first and second braking rolls being in contact with the web as the web passes about their associated idler rolls, respectively, when the first and second braking rolls are in their braking positions, and with the rotational axis of each of the first and second braking rolls being substantially parallel with the rotational axis of its associated idler roll; (b) a movable elongated bar that is disposed adjacent to the first and second braking rolls and that is selectively movable between a first position wherein a side of the elongated bar may be selectively moved into contact with the first braking roll when the first braking roll is in its braking position and a second position wherein a side of the elongated bar may be selectively moved into contact with the second braking roll when the second braking roll is in its braking position; (c) means for moving a side of the elongated bar into contact with one of the first and second braking rolls such that when the elongated bar is moved into contact with a braking roll, that braking roll then clamps the web running between that braking roll and its associated idler roll so as to stop the running of the web; and (d) means for holding the side of the elongated bar in contact with one of the first and second braking rolls;

(5) means for sensing the passage of a pattern on the expiring web during a splice, with the sensing means being positioned at a second pre-selected point downstream from the first pre-selected point and adjacent to the path of travel;

(6) means for relatively slowly moving the stopped portion of the expiring web along the first section of the path of travel and past the sensing means upon the substantial stopping of the portion of the expiring web during a splice, with the web-moving means including means for slowly moving the elongated bar in a direction substantially parallel to its side, when the elongated bar is in its first and second positions, so that such movement of the elongated bar causes rotation of the braking roll, then in contact with the elongated bar, which, in turn, causes movement of the expiring web clamped between the braking roll and its associated idler roll;

(7) means for securing the leading end of the new web to an adjacent part of the portion of the expiring web after the next pattern on the expiring web has been moved past the sensing means by the web-moving means;

(8) means for cutting the portion of the expiring web immediately upstream from the secured part of the portion of the expiring web after the next pattern on the expiring web has been moved past the sensing means by the web-moving means and after part of the leading end of the new web has been secured to the part of the portion of the expiring web; and (9) means for permitting the joined new web to move along the path of travel at the relatively high speed, the permitting means including means for permitting the side of the elongated bar to move out of contact with the braking roll.

2. The improved web splicer described in claim 1 wherein a splice is initiated when the trailing end of the expiring web runs off the expiring roll; and wherein the sensing means senses the register mark.

3. The improved web splicer described in claim 1 wherein the first section of the path of travel defines a plane; and wherein the securing means includes an anvil positioned adjacent to the first section and on one side of the plane, and a movable hammer positioned adjacent to the first section and opposed to the anvil on the other side of the plane.

4. The improved web splicer described in claim 3 wherein the securing means includes a strip of adhesive tape that is secured to and between the leading end of the new web and the part of the portion of the expiring web by movement of the hammer against the anvil.

5. The improved web splicer described in claim 1 wherein one end of the elongated bar is mounted for pivotable movement about a third point that is itself movable between a first position and a second position; wherein when the third point is in its first position, the elongated bar is in its first position; and wherein when the third point is in its second position, the elongated bar is in its second position.

6. The improved web splicer described in claim 5 wherein the other end of the elongated bar is connected with the means for relatively slowly moving the elongated bar; and wherein the same side of the elongated bar contacts the first and second braking rolls and wherein the means for relatively slowly moving the bar moves the elongated bar in one direction, parallel to the longitudinal axis of the elongated bar, when the elongated bar is in its first position and moves the elongated bar in the same direction when the elongated bar is in its second position.

7. The improved web splicer described in claim 6 wherein the splicing operation is inhibited when the trailing end of the expiring web runs off of the expiring roll; and wherein the securing means includes an anvil position adjacent to the first section and on one side of the plane, and a movable hammer positioned adjacent to the first section and oppositely to the anvil on the other side of the plane.

8. The improved web splicer described in claim 6 wherein the rotational axes of the first and second braking rolls are substantially parallel; and wherein the side of the elongated bar is substantially parallel to the longitudinal axis of the elongated bar.

9. The improved web splicer described in claim 1 wherein the rotational axes of the first and second braking rolls are substantially parallel; and wherein the side of the elongated bar is substantially parallel to the longitudinal axis of the elongated bar.

* * * * *